United States Patent [19]

Wiseheart

[11] 4,165,856

[45] Aug. 28, 1979

[54] ADJUSTABLE ARTIST'S EASEL

[76] Inventor: Keith H. Wiseheart, 402 Sixth Ave., Baraboo, Wis. 53913

[21] Appl. No.: 806,578

[22] Filed: Jun. 15, 1977

[51] Int. Cl.[2] ..... A47B 97/08

[52] U.S. Cl. ..... 248/449; 248/455; 248/458; 248/161; 248/415

[58] Field of Search ..... 248/11, 161, 185, 354 P, 248/449, 451, 452, 453, 454, 455, 458, 460

[56] References Cited

U.S. PATENT DOCUMENTS

| | | | |
|---|---|---|---|
| 391,608 | 10/1888 | Hartwell | 248/449 |
| 916,080 | 3/1909 | Wilkinson | 248/415 X |
| 1,219,959 | 3/1917 | Kruger | 248/455 |
| 1,707,226 | 4/1929 | Kepple | 248/354 P |
| 1,869,278 | 7/1932 | Ramelli | 248/455 |
| 3,091,886 | 6/1963 | Nutting | 248/454 X |
| 3,147,948 | 9/1964 | Evanoff | 248/455 |
| 3,637,172 | 1/1972 | Diesbach | 248/460 |
| 3,738,606 | 6/1973 | Millen | 248/460 X |
| 3,918,108 | 11/1975 | Feyerherm | 248/415 X |
| 3,934,806 | 1/1976 | Rady | 248/460 X |

FOREIGN PATENT DOCUMENTS

| | | | |
|---|---|---|---|
| 404115 | 6/1966 | Switzerland | 248/455 |
| 222780 | 10/1924 | United Kingdom | 248/455 |

*Primary Examiner*—William H. Schultz
*Attorney, Agent, or Firm*—Harry C. Engstrom; Theodore J. Long; Nicholas J. Seay

[57] ABSTRACT

An easel having a flat surfaced easel board mounted upon a single pedestal, the easel board being rotatable on the pedestal about horizontal and vertical axes. The pedestal is mounted upon a support base and is adjustable in height so that the easel board can be raised or lowered by adjusting the pedestal to a selected position. Extensible work holding clamps are provided at the top and bottom of the easel board. The easel is adapted to be disassembled for portability.

5 Claims, 2 Drawing Figures

ADJUSTABLE ARTIST'S EASEL

BACKGROUND OF THE INVENTION

1. Field of the Invention

This invention pertains generally to the field of artist's easels.

2. Description of the Prior Art

The common artist's easel consists of a tripod having a horiziontal bar or bars thereon which may be adjustable to hold the artist's workpiece in place. The most basic tripod easels usually do not have provision for adjusting either the height of the workpiece or the angle at which the work is presented to the artist.

More complex and expensive easels built for professional artists provide for adjustment of the height of the workpiece as well as limited adjustment of the angle at which the workpiece is held. However, the more complex easels are generally quite large and not easily portable, and generally utilize a tripod base construction.

Because of the tripod structure, the entire easel must be rotated to change the direction in which the workpiece faces, and the spreading support legs of the easel are in position to interfere with an artist standing or sitting close to the easel. Since such easels are primarily adapted for supporting and holding a rigid workpiece, such as a frame backed canvas, they do not have provision for a drawing surface which can be used as a backing for making preliminary drawings or sketches.

SUMMARY OF THE INVENTION

In accordance with my invention, a flat surfaced easel board is rotatably mounted to a pedestal which is itself supported firmly upon a base. The pedestal is extensible to allow the easel board to be adjusted up and down in height, and the easel board may be rotated on the pedestal about a vertical axis to a position chosen by the artist. Provision is made to clamp and firmly hold the easel board at a selected angle with respect to the artist. Work holding clamps mounted at the top and bottom of the easel board can be adjusted upwardly and downwardly into position to contact and firmly hold the workpiece between them.

The single pedestal support design of my easel is particularly advantageous since it allows an artist to work next to the easel in a sitting position without having portions of the easel interfere with the artist's legs.

The planar drawing surface of the easel board provides a firm backing on which drawing paper can be placed to allow the artist to make preliminary sketches or drawings. Yet, the work holding clamps at the top and bottom of the easel board allow workpieces of widely varying sizes to be held and firmly positioned on the easel.

Although my easel has the advantage of the single pedestal design which minimizes interference of the easel with the artist, it also provides a very firm and stable support for the workpiece. In particular, the base is adapted to provide extensible horizontal stabilizers which can be extended outwardly from the corners of the base to provide a wide area base support. The pedestal itself is firmly and rigidly mounted at one end to the base and at the other end to the easel board. For indoor use, the base can be provided with casters or rollers to allow the easel to be easily moved around within a room.

My easel has the further advantage of being easily disassembled and rearranged in compact relationship to provide for portability.

Further objects, features, and advantages of my invention will be apparent from the following detailed description, taken in conjunction with the accompanying drawings showing a preferred embodiment on an adjustable artist's easel exemplifying the principles of my invention.

DESCRIPTION OF THE PREFERRED EMBODIMENT

Figure 1:
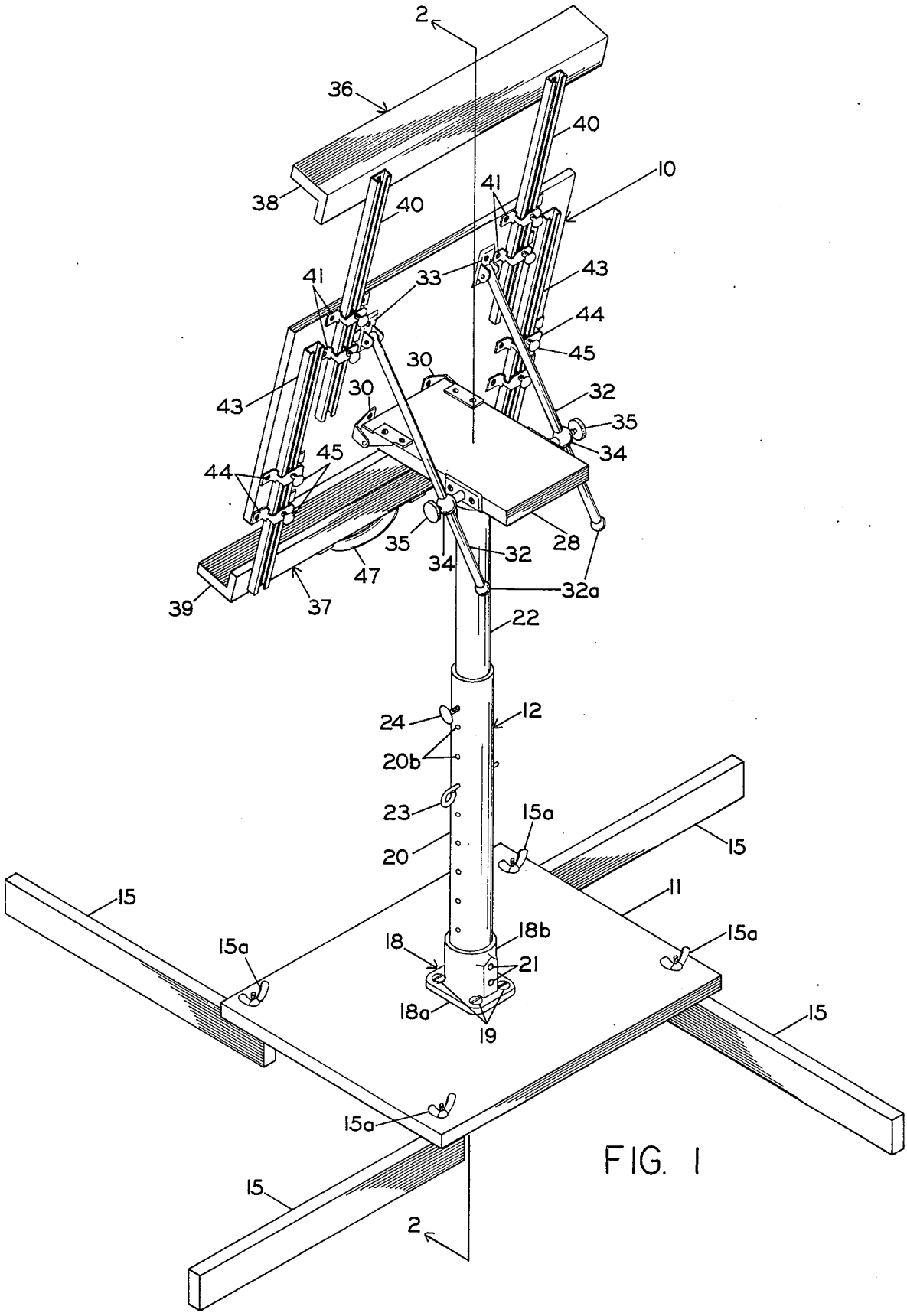
FIG. 1 is a perspective view of my adjustable easel shown in assembled relation.

Referring now more particularly to the drawings, wherein like numerals refer to like parts in both views, a preferred embodiment of my adjustable artist's easel is shown generally at 10 in FIG. 1. The easel 10 includes a base 11, a pedestal 12 mounted uprightly to the base, and a substantially flat surfaced easel board 13 mounted to the top of the pedestal for rotation on the pedestal around a horizontal axis. The artist's workpiece, such as a canvas on a rigid frame, is emplaced upon the easel board 13 and is supported thereby.

Figure 2:
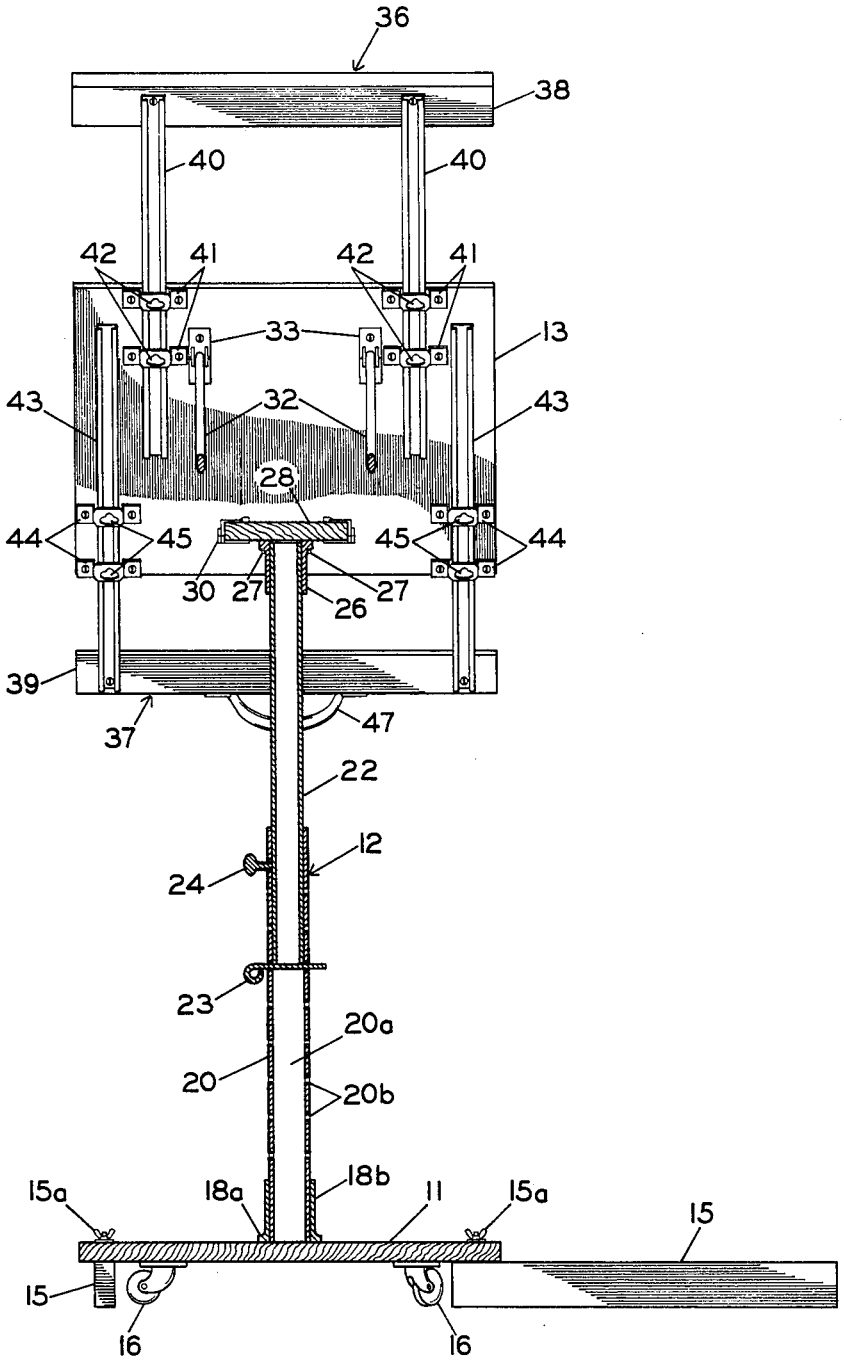
FIG. 2 is a cross-sectional view thereof taken along the line 2—2 of FIG. 1.

The base 11 preferably has a flat bottom surface which extends out a substantial distance from the mounting position of the pedestal 12 so as to provide firm support for the easel. To improve the stability of the easel, stabilizer bars 15 are pivotally mounted to the bottom of the base at each corner thereof by bolt and thumbscrew combinations 15*a*, and are positioned to swing out from the edges of the base to outstretched positions in which the bars 15 provide a wide, firm footing for the easel. Where the easel is to be used indoors on a relatively smooth floor surface, the stabilizer bars 15 may be swung back to fold under the base 11, or may be removed completely. Casters 16 can be mounted at the corners of the base, or inwardly from the stabilizer bars, as shown in FIG. 2, to provide rolling support for the easel when it is being used indoors. This feature provides particular convenience to the indoor artist, since the easel may be moved to a convenient position and caster locks (not shown) of standard design may be locked on the casters to prevent the easel from moving.

The preferred mounting of the pedestal 12 to the base 11 is shown in FIG. 1. A mounting member 18 has a circular plate portion 18*a* thereof which is rigidly attached to the base 11 by a plurality of screws 19. The mounting member 18 also has a socket portion 18*b* which extends upward from the plate 18*a*. A sleeve member 20 of the pedestal 12 is adapted to fit within the opening of the socket 18*b* and to be supported uprightly therein. To secure the sleeve member within the socket, set screws 21 are threadingly engaged through the socket and turned into contact with the sleeve member to firmly hold the same within the socket. The set screws can be selectively turned out to release the sleeve member 20 when it is desired to disassemble the easel in order to more conveniently transport it.

The construction of the pedestal 12 is best shown with reference to the cross sectional view of FIG. 2. As shown therein, the sleeve member 20 fits snugly into the socket 18*b* of the mounting member 18 and is held uprightly therein. Fitting within the circular internal bore 20*a* of the sleeve member is a post 22. The post fits closely within the bore 20*a* and is slidably movable up and down therein. A plurality of pairs of holes 20*b* are formed on opposite sides of the sleeve member 20, with the pairs of holes being distributed in spaced relation along a portion of length of the sleeve member. A rod-key 23 is adapted to fit within the pairs of holes 20*b* and extend across the bore of the sleeve member. As shown in FIG. 2, the post 22 rests upon and is provided vertical support by the key 23. The vertical height of the easel board may be adjusted by selecting the appropriate pair of holes into which the key 23 is inserted, and bringing the post 22 to rest upon the key in that position. It is apparent that this construction allows the post 22 to rotate within the sleeve 20, so that the easel board 13 can be rotated on the post around a vertical axis to a desired position. To secure the post in a desired position, a thumbscrew 24 is threadingly engaged to the sleeve 20 such that it can be turned inwardly into contact with the post 22 to hold the same firmly in position within the sleeve member.

The top of the post 22 is held within the socket of a second mounting member 26 and is maintained therein by turning of set screws (not shown in FIG. 2) through the mounting member into contact with the post. The mounting member 26 is itself attached by a plurality of screws 27 to the underside of a generally horizontally extending support panel 28.

The easel board 13 is rotatably mounted to the support panel 28 of the pedestal by hinges 30 which allow the easel board to rotate around a horizontal axis from a generally upright vertical position, through approximately 90°, to a generally horizontal position in which the easel board is resting firmly upon the support panel 28. It should be understood that "horizontal" and "vertical" as described herein refer to the orientation of my easel when the base 11 thereof is supported by a flat horizontal surface.

To allow the easel board 13 to be secured at a selected rotational position with respect to the pedestal, adjustment rods 32 are pivotally mounted by pivots 33 to the underside of the easel board, and are slidingly engaged within collars 34 which are themselves pivotally mounted to opposite edges of the support panel 28. It is seen that as the easel board is rotated up and down, the adjustment rods 32 will slide freely in the collars 34. An adjustment screw 35 is threadingly engaged with each collar and can be turned into contact with the adjustment rod to restrain the same in a selected position. The firmly held adjustment rod will thus firmly restrain the easel board in place at the selected angle. As shown in FIG. 1, enlarged knobs 32*a* are formed on the ends of the rods 32 to prevent the rods from slipping out of the collars 34.

The artist's workpiece is held in place on the easel board by upper and lower adjustable clamps 36 and 37 respectively. The use of both upper and lower clamps allows larger workpieces to be accommodated on the easel board, although it is apparent that only one of the clamps need be used if the pieces being utilized are sufficiently small. In such a case, the lower clamp 37 would be maintained in its position next to the easel board while the upper clamp is adjusted to clamp onto the top of the workpiece. For such applications, the lower clamp could alternatively be replaced by a ledge permanently affixed to the bottom of the easel board.

The upper and lower adjustable clamps 36 and 37 are similarly constructed. The upper and lower clamps have beveled faced bracket members 38 and 39, respectively, which extend laterally substantially across the upper and lower edges of the easel board 13. The upper bracket member 38 is attached to a pair of upper extension channels 40 which are themselves mounted to the underside of the easel board 13 by a pair of channel brackets 41. Thumbscrews 42 are threaded through the channel brackets to make contact with the extension channels 40 and hold the same firmly in a desired position.

Similarly, the lower bracket member 39 is attached to a pair of lower extension channels 42 which are each slidably mounted to the underside of the easel board 13 by a pair of channel attachment brackets 44. Thumbscrews 45 are screwed through the channel brackets 44 into contact with the lower extension channels to hold them in the desired position.

The artist can perform preliminary sketches on drawing paper situated on the flat surface of the easel board, and can adjust the board to a desired tilt in order to perform such work. Where larger rigid work pieces such as framed canvases are to be held, the adjustable clamps 36 and 37 may be loosened from their mountings and slid up or down until sufficient space between them is provided to accommodate the workpiece. The lower clamp may then be secured in place by tightening the thumbscrews 45, and the upper clamp may be pulled down until the upper bracket member 38 comes into contact with the top of the workpiece, with the upper thumscrews 42 thereafter tightened to securely hold the workpiece in place.

My easel is well adapted to be easily disassembled for portability. For example, the easel may be broken down as indicated below.

The easel board is swung down flat against the panel 28 and the screws 35 are tightened to hold this position. The stabilizer bars 15 are swung in under the base 11 and are secured in position by tightening the wing nut and bolt combinations 15*a*. Similarly, the upper clamp 36 and lower clamp 37 are withdrawn back to the easel board 13 and are secured by tightening the thumbscrews 42 and 45, respectively. The easel board may then be removed from attachment to the pedestal by (1) loosening the set screws (not shown) which hold the mounting member 26 to the post 22, and (2) lifting the easel board upwardly. Similarly, the set screws 21 may be loosened to allow the sleeve member 20 to be removed from the mounting member 18. The post may be fully telescoped with the sleeve member by removing the rod key 23, loosening the thumbscrew 24 to allow the post to slide fully into the sleeve member, and then retightening the thumbscrew. It is seen that all of the parts of the easel are now compactly arranged, and may be assembled and secured together in a relatively small package for easy conveyance. For convenience in carrying the compacted easel, a carrying handle 47 is mounted to the lower bracket member 39.

It is understood that my invention is not confined to the particular construction and arrangement of parts herein illustrated and described, but embraces all such modified forms thereof as come within the scope of the following claims.

I claim:

1. An adjustable easel for artists, comprising:

(a) a square base;

(b) an easel board having a substantially flat surface;

(c) a pedestal having a sleeve member mounted to said base and extending upwardly therefrom, said sleeve member having a hollow circular interior bore, said pedestal also having a post adapted to be closely received in the bore of said sleeve member and held in telescoping relation therewith, said easel board being rotatably mounted to said post for rotation about a horizontal axis and said post being rotatable within said sleeve member to thereby provide for rotation of said easel board about a vertical axis;

(d) means for holding said post at a selected one of a plurality of vertical positions within said sleeve member to thereby provide for selection of the height of said easel board above said base;

(e) means for adjustably securing said easel board at a selected rotational position with respect to said pedestal;

(f) clamp means slidingly mounted to said easel board for engaging and holding a workpiece in position on said easel board; and (g) a plurality of stabilizer bars no longer than the sides of said base which are rotatably mounted to the underside of said base at the corners thereof in position to be swung out from the base into an extended position to provide additional lateral stability to said base and to the remainder of said easel supported thereon.

2. An adjustable easel for artists, comprising:

(a) a base;

(b) an easel board having a substantially flat surface;

(c) a pedestal having a sleeve member mounted to said base and extending upwardly therefrom, said sleeve member having a hollow circular interior bore, said pedestal also having a post adapted to be closely received in the bore of said sleeve member and held in telescoping relation therewith, said easel board being rotatably mounted to said post for rotation about a horizontal axis and said post being rotatable within said sleeve member to thereby provide for rotation of said easel board about a vertical axis;

(d) means for holding said post at a selected one of a plurality of vertical positions within said sleeve member to thereby provide for selection of the height of said easel board above said base, said means for holding said post at a selected one of a plurality of vertical positions including a plurality of pairs of holes formed in opposite sides of said sleeve member and distributed in spaced relation along a portion of the length thereof, a rod-key adapted to fit within said pairs of holes at a selected pair thereof to thereby block the bore of said sleeve member and to engage the bottom of said post to support said post within said sleeve member, whereby said post can rotate with the bore of said sleeve while being supported by said rod-key, and also including a thumbscrew threadingly engaged with said sleeve member and adapted to be turned therethrough into contact with said post to firmly secure the same in its selected position within the sleeve member;

(e) means for adjustably securing said easel board at a selected rotational position with respect to said pedestal and;

(f) clamp means slidingly mounted to said easel board for engaging and holding a workpiece in position on said easel board.

3. An adjustable easel for artists, comprising:

(a) a base;

(b) an easel board having a substantially flat surface;

(c) a pedestal having a sleeve member mounted to said base and extending upwardly therefrom, said sleeve member having a hollow circular interior bore, said pedestal also having a post adapted to be closely received in the bore of said sleeve member and held in telescoping relation therewith and a support panel mounted to said post, said easel board being rotatably mounted to said support panel on said post for rotation about a horizontal axis and said post being rotatable within said sleeve member to thereby provide for rotation of said easel board about a vertical axis;

(d) means for holding said post at a selected one of a plurality of vertical positions within said sleeve member to thereby provide for selection of the height of said easel board above said base;

(e) means for adjustably securing said easel board at a selected rotational position with respect to said pedestal including at least one adjustment rod pivotally mounted at one end thereof to said easel board, a collar pivotally mounted to said support panel and slidingly engaging said adjustment rod therein, and an adjustment screw threadingly engaged to said pivotally mounted collar and adapted to be turned therein to firmly engage said adjustment rod to restrain said rod from sliding in said collar and to thereby restrain said easel board from rotation, and;

(f) clamp means slidingly mounted to said easel board for engaging and holding a workpiece in position on said easel board.

4. An adjustable easel for artists, comprising:

(a) a base;

(b) an easel board having a substantially flat surface;

(c) a pedestal having a sleeve member mounted to said base and extending upwardly therefrom, said sleeve member having a hollow circular interior bore, said pedestal also having a post adapted to be closely received in the bore of said sleeve member and held in telescoping relation therewith, said easel board being rotatably mounted to said post for rotation about a horizontal axis and said post being rotatable within said sleeve member to thereby provide for rotation of said easel board about a vertical axis;

(d) means for holding said post at a selected one of a plurality of vertical positions within said sleeve member to thereby provide for selection of the height of said easel board above said base;

(e) means for adjustably securing said easel board at a selected rotational position with respect to said pedestal and;

(f) clamp means slidingly mounted to said easel board for engaging and holding a workpiece in position on said easel board including an upper bracket member extending laterally at the top of said easel board for engaging the top of a workpiece thereon, at least two upper extension channels attached to said upper bracket member and slidably attached to the underside of said easel board by channel brackets, and thumbscrews threadingly engaged to said channel brackets in position to be turned into engagement with said upper extension channels to restrain the same and hold them in a selected position.

5. The easel of claim 4 including a lower bracket member extending laterally at the bottom of said easel board for engaging the bottom of a workpiece thereon, at least two lower extension channels attached to said lower bracket member and slidably attached to the underside of said easel board by channel brackets and thumbscrews threadingly engaged to said channel brackets in position to be turned into and engage said lower extension channels to restrain the same and hold them in a selected positon.

* * * * *